US006328012B1

(12) United States Patent
Clements

(10) Patent No.: US 6,328,012 B1
(45) Date of Patent: Dec. 11, 2001

(54) CYLINDER HEAD AND VALVE CONFIGURATION

(76) Inventor: Michael L. Clements, 140 S. Equestrian Ct., Gilbert, AZ (US) 85296

( * ) Notice: Subject to any disclaimer, the term of this patent is extended or adjusted under 35 U.S.C. 154(b) by 0 days.

(21) Appl. No.: 09/571,079

(22) Filed: May 15, 2000

(51) Int. Cl.[7] ..... F02N 3/00

(52) U.S. Cl. ..... 123/188.4; 123/48 R; 123/78 R

(58) Field of Search ..... 123/188.4, 188.2, 123/188.3, 188.7, 78 R, 48 R, 78 D, 48 D

(56) References Cited

U.S. PATENT DOCUMENTS

| | | | | |
|---|---|---|---|---|
| 1,218,317 | * | 3/1917 | Rich . | |
| 1,250,463 | * | 12/1917 | Hutchinson . | |
| 1,252,501 | | 1/1918 | Shepard . | |
| 1,318,227 | | 10/1919 | Nyhagen . | |
| 1,360,536 | * | 11/1920 | Kelly . | |
| 1,443,911 | | 1/1923 | Burtnett . | |
| 1,608,020 | | 11/1926 | Grace . | |
| 1,680,099 | | 8/1928 | Gray . | |
| 1,749,552 | | 3/1930 | Warren . | |
| 1,759,425 | | 5/1930 | Suekoff . | |
| 1,777,792 | | 10/1930 | Grace . | |
| 1,784,555 | | 12/1930 | Summers . | |
| 1,804,873 | | 5/1931 | Hoffman . | |
| 1,856,348 | | 5/1932 | McMillan . | |
| 1,910,813 | | 5/1933 | Powell . | |
| 1,922,678 | | 8/1933 | Hallett | 123/188 |
| 1,942,648 | | 1/1934 | Jensen | 123/188 |
| 2,080,126 | | 5/1937 | Gibson et al. | 123/188 |
| 2,111,601 | | 3/1938 | Rabezzana et al. | 123/191 |
| 2,201,292 | | 5/1940 | Hickey | 123/75 |
| 3,916,866 | | 11/1975 | Rossi | 123/197 R |
| 3,924,582 | | 12/1975 | Yagi et al. | 123/32 SP |
| 4,344,408 | | 8/1982 | Inoue et al. | 123/661 |
| 4,745,891 | | 5/1988 | Cola | 123/193 |
| 5,269,210 | | 12/1993 | Johnson | 82/47 |
| 5,320,075 | | 6/1994 | Regueiro | 123/310 |
| 5,605,125 | | 2/1997 | Yaoita et al. | 123/175 |

FOREIGN PATENT DOCUMENTS

| | | |
|---|---|---|
| 22408 | of 1911 | (GB) . |
| 24989 | of 1911 | (GB) . |
| 27452 | of 1912 | (GB) . |

* cited by examiner

*Primary Examiner*—Tony M. Argenbright
*Assistant Examiner*—Katrina B. Harris
(74) *Attorney, Agent, or Firm*—Douglas W. Rudy

(57) ABSTRACT

Disclosed is a valve and head assembly for use in a flat head style internal combustion engine. The valve has a cup portion above the face of the valve. The cup portion of the valve moves longitudinally in a sleeve or liner and a retainer plate retains the liner in the head of the engine.

14 Claims, 4 Drawing Sheets

FIG. 1
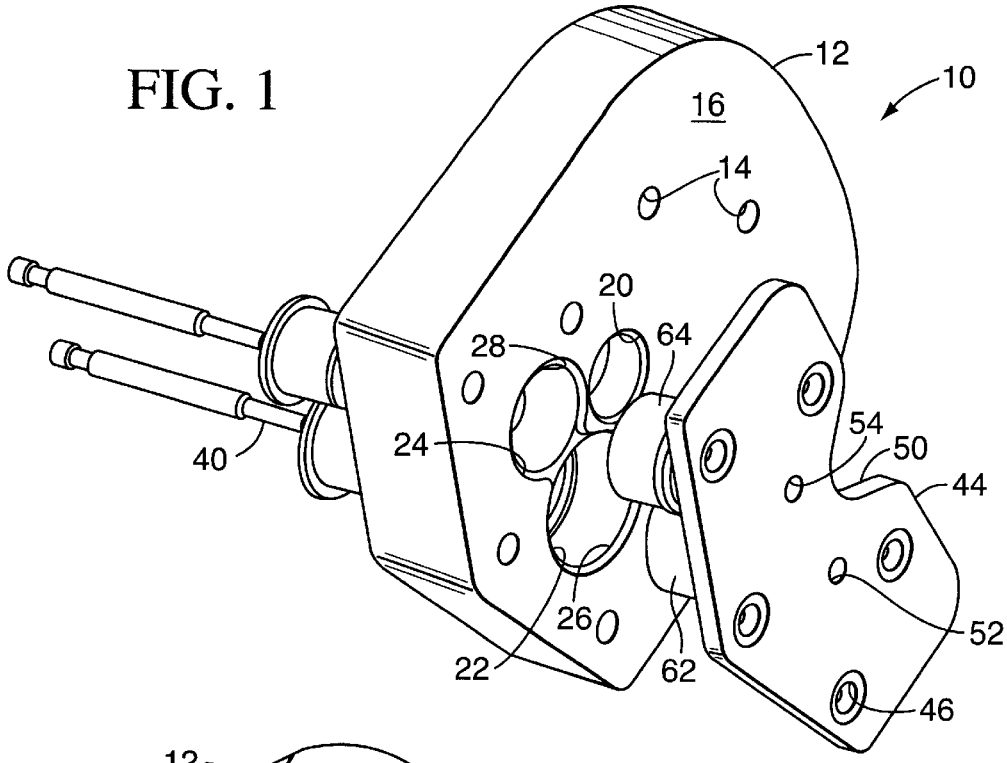
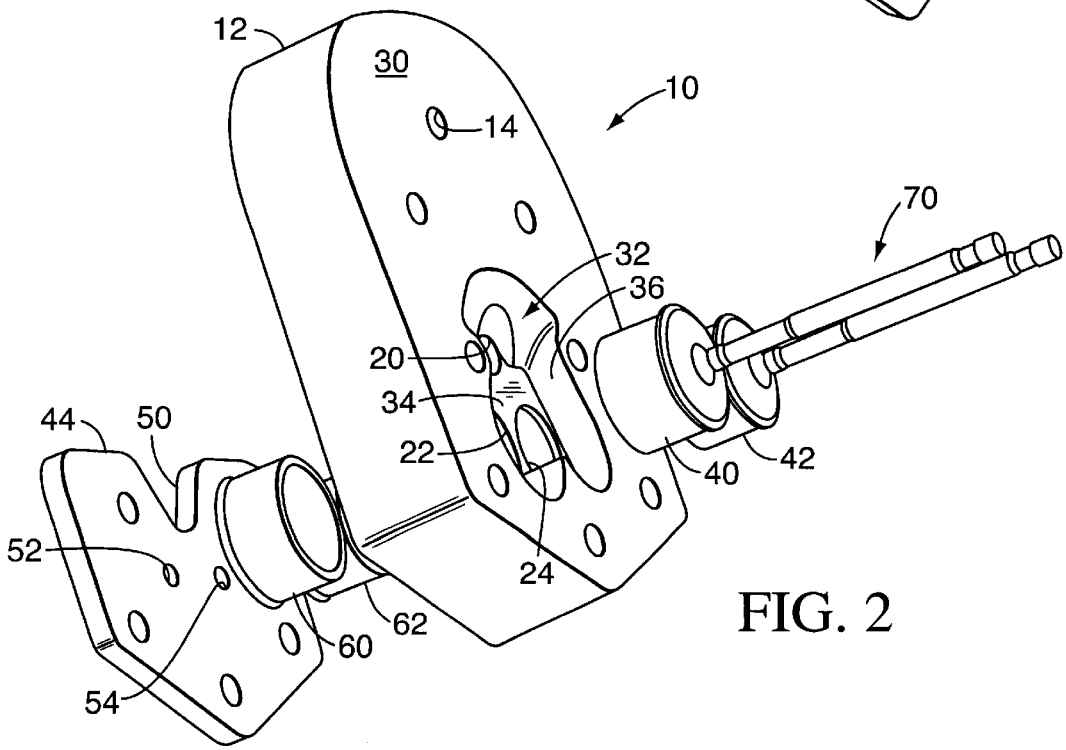
FIG. 2

CYLINDER HEAD AND VALVE CONFIGURATION

BACKGROUND OF THE INVENTION

1. Field of the Invention

This invention pertains to a cylinder head configuration, valves having an extended head height for use with the cylinder head, the cylinder head being internally configured to accept these valves. The cylinder head and the intake and exhaust valve configurations are for use with flathead engines. The combustion chamber shape and gas flow through the combustion chamber of the cylinder head results in an increase of combustion efficiency, a reduction of hydrocarbon emissions and an increase in compression ratio.

2. Description of the Related Art

It is known to provide four cycle engines with side valve, "L-head" or flathead type cylinder heads with integral combustion chambers, hereinafter "flathead" engines. These engines do not have valves opposite the top surface of the piston, but instead, have the valves adjacent the piston. The flathead engine has a head with a cavity formed in it. This cavity provides the combustion chamber for the engine.

A combustible fluid, such as a mixture of air and fuel, is directed to the combustion chamber through an intake valve. An exhaust valve allows spent gasses through a passage to an exhaust manifold, thus the exhaust is evacuated from the combustion chamber.

The flathead engine was in widespread use through the 1950's, including automotive use, but has been superceded in many applications by overhead valve engines. The flathead engine continues to be widely used in small displacement four cycle engines having one or two cylinders. Typical applications for four cycle flathead engines are found in gas operated lawn mowers, electric generator power systems, snowblowers, weed trimmers, lawn edgers, go kart motors, boat engines and the like.

There have been many intake/exhaust/valve configurations in the development of the flathead engine. Many of these valve configurations use slide valves, shuttle valves or poppet valves.

For instance, a flathead engine with a poppet valve configuration is shown in U.S. Pat. No. 1,784,555. A slide type valve, a piston type valve and a sleeve type valve are shown in U.S. Pat. Nos. 1,856,348; 1,680,099 and 1,922,678. None of these patents show the valve configuration presented herein.

The age of these patents and the paucity of modern day patents concerning valve systems for flathead engines show that there has been a dearth in the generation of ideas relating to flathead engines. This invention is directed to a system that makes the four cycle flathead engine more competitive with the overhead valve and overhead camshaft engines in vogue and being developed today. The overhead valve engines are more expensive to produce than the flat engine and there are great advantages in production economics if an improvement can be made in the efficiency and especially in reducing hydrocarbon emissions of the flathead engine.

One advantage of this invention is that hydrocarbon emissions are reduced to the point where small engine manufacturers can produce a clean burning engine without having to resort to an overhead valve configuration to get equivalent hydrocarbon emissions.

SUMMARY OF THE INVENTION

The invention is a cylinder head for use on a flathead type four cycle engine. A combustion chamber is formed in the head. A poppet valve, having a cup shaped extension extending from the face of the valve, will move into and partially through the combustion chamber in order to allow gas to enter and exit the combustion chamber.

The cup of the valve will move into and out of a recess formed in the cylinder head in line with the valve. The cup surface and the valve cup receiving recess will be a sealed sliding fit.

The valve cup eliminates the open volume above the valve faces in the combustion chamber allowing better use and configuration of the combustion chamber.

In one embodiment of the invention the valve cup receiving recess is provided with a liner bore to line the recess. This allows the use of alternative sealing structures, metal compounds and modifications to valve sizing when using a standard head for engines with a choice of valve diameters.

One object of this invention to increase the efficiency of an internal combustion engine and decrease the hydrocarbon emissions of such engine.

Another object of this invention is to increase the compression ratio of an engine.

It is also an object of this invention to provide a valve system that can be installed on a contemporary engine without significant engine modification.

It is also an object of this invention to provide a lightweight valve cup.

Another object of this invention to provide a two-piece valve system with a valve having cup portion.

A further object of this invention is to provide a construction of a valve stem and cup valve using friction welding.

It is another object of the invention to provide a removable access cover on a head of a flathead engine.

It is also an object of the invention to provide a pulse drive source of pressure, vacuum, or a combination of pressure and vacuum to drive a pulse driven motor, pump or other device.

The preferred embodiments of the invention presented here are described below in the drawing figures and Detailed Description of the Invention. Unless specifically noted, it is intended that the words and phrases in the specification and the claims be given the ordinary and accustomed meaning to those of ordinary skill in the applicable arts. If any other special meaning is intended for any word or phrase, the specification will clearly state and define the special meaning.

Likewise, the use of the words "function" or "means" in the Detailed Description of the Invention is not intended to indicate a desire to invoke the special provisions of 35 U.S.C. 112, Paragraph 6, to define the invention. To the contrary, if the provisions of 35 U.S.C. 112, Paragraph 6 are sought to be invoked to define the inventions, the claims will specifically state the phrases "means for" or "step for" and a function, without also reciting in such phrases any structure, material or act in support of the function. Even when the claims recite a "means for" or "step for" performing a function, if they also recite any structure, material or acts in support of that means or step, then the intention is not to invoke the provisions of 35 U.S.C. 112, Paragraph 6. Moreover, even if the provisions of 35 U.S.C. 112, Paragraph 6 are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, material or acts for performing the claimed function.

BRIEF DESCRIPTION OF THE DRAWINGS

The features of the invention is described in detail below by way of example in which the drawings include:

FIG. 1 an expanded, projected, top view of a cylinder head and associated valves;

FIG. 2 is an expanded, projected bottom view of the cylinder head and associated valves shown in FIG. 1;

DETAILED DESCRIPTION OF THE INVENTION

Figure 3:
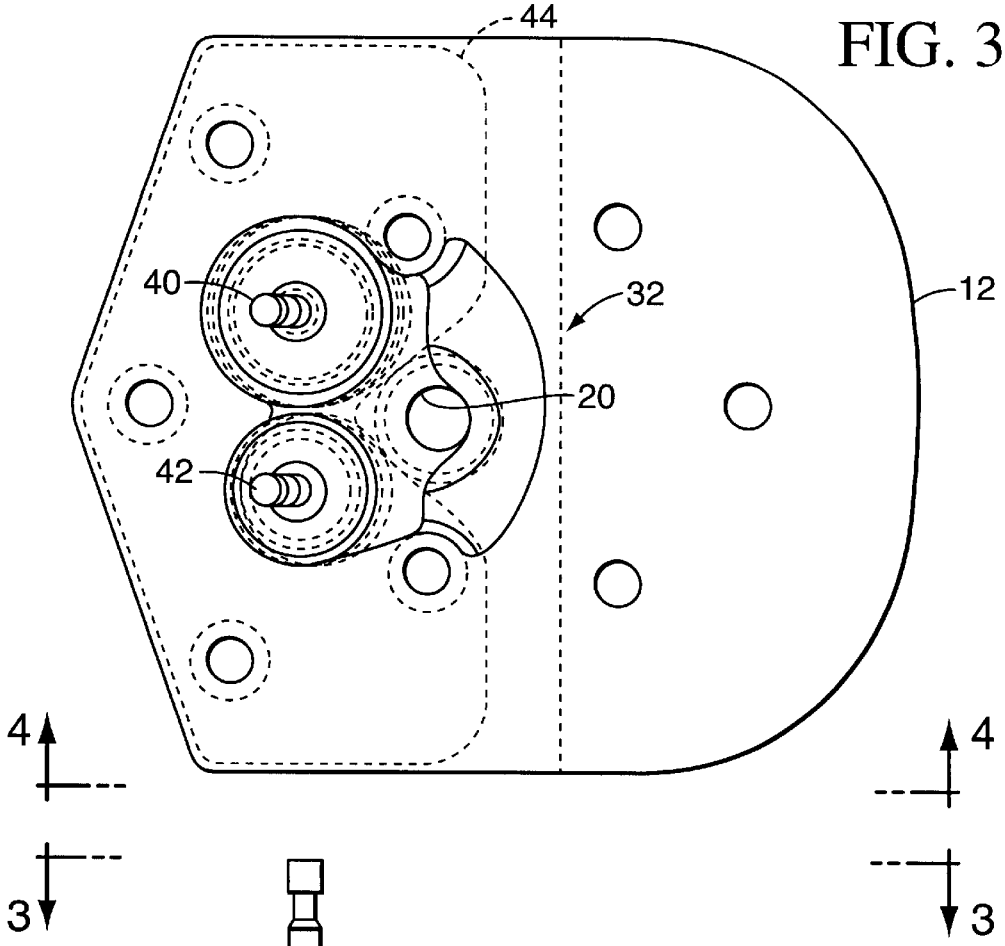
FIG. 3 is the bottom view of the unexpanded cylinder head shown in FIG. 1.

The invention is a cylinder head for use on a four-stroke poppet valve type internal combustion engine. The inventor contemplates various embodiments of the invention and the configuration of a preferred embodiment and several alternative embodiments are set forth herein.

One embodiment is shown in FIGS. 1 and 2. In these views the cylinder head and valve assembly generally 10, includes a head 12. The head 12 is for attachment to an engine block (not shown) using fasteners that will pass through holes in the head such as through bore 14. The head 12 is generally a monolithic block of material, such as aluminum, steel or iron that can be machined from billet stock, cast and machined, or otherwise formed in a conventional manner. Although shown as a generally flat surfaced structure it would not be unusual to have cooling fins integrally cast or machined into the head for heat dissipation and the control of heat buildup. It is also contemplated that the head may be water jacketed for cooling for use with a liquid cooled engine.

The topside 16 of the head 12 includes a through bore 20 that is a spark plug receiving hole. It will be threaded to accommodate a spark plug or other ignitor.

An intake valve accommodating bore ("intake bore") 22 is machined through the head. Likewise an exhaust valve accommodating bore ("exhaust bore") 24 is also machined or formed in the head 12. Each of these bores can be cast-in-situ bores or machined bores, either a machined casting or a completely machined bores depending on designer preference and whether or not the bore is sleeved as will be discussed further on in this specification.

As shown in FIG. 1, bores 22 and 24 may include recesses 26 and 28 respectively. These recesses may be fully circumferential (not shown) depending on the relative location of the intake and exhaust bores 22 and 24. Alternatively, as shown in FIG. 1, the recesses can be discontinuous or actually meld into a non-circumferential zone as shown.

Turning to FIG. 2, the relative bottom side 30 of the head 12 can be clearly seen. In this figure the through holes such 14, the spark plug bore 20, the intake bore 22, and the exhaust bore 24 are shown. The combustion chamber, generally 32, is a cavity machined or otherwise formed as a depression in the surface of the head surface bottom side 30. The combustion chamber includes a roof 34 and other features formed in the chamber surrounded by walls such as 36.

Shown in FIG. 1 and more clearly in FIG. 2, are an intake valve 40 and an exhaust valve 42. They will be discussed in detail further on in this disclosure.

A retainer plate 44 is provided to cover the intake bore 22 and exhaust bore 24. This retainer plate includes a number of through bores, such as head bolt bores 46, five shown, as well as a relief zone 50 that allows access to the spark plug bore 20 so that a spark plug can be inserted easily into the spark plug bore 20.

In one embodiment of the invention a pair of bleed holes, intake bleed hole shown as 52 and exhaust bleed hole shown as 54, are provided. In another embodiment, these two bleed holes, 52 and 54 can be connected by a tube. These bleed holes are the source of pressure and vacuum. As valve opens it generates pressure and a pulse of compressed air exits a bleed hole. As a valve closes a vacuum or suction is created. These pulses are harnessed, in some embodiments using a configuration including check valves, to drive a pump, such as a fuel pump, or other ancillary equipment.

As shown most clearly in FIG. 2, an intake bore liner ("intake liner") 60 and an exhaust bore liner ("exhaust liner") 62 are shown. These are designed to fit into the respective intake 22 and exhaust 24 bores and will be held in place in the bores by contact with the retainer plate 44. The interior of the intake liner 60 and the interior of the exhaust liner 62 will line up with the intake bleed hole 52 and the exhaust bleed hole 54, respectively, when such bleed holes are used in a particular embodiment.

The detail structure of the intake 40 and exhaust 42 valves can best be appreciated by perusing FIGS. 5–8.

Each of the valves are similar in construction so only the intake valve will be described. The exhaust valve is virtually identical, the only difference, in a preferred embodiment, is that the intake valve has a larger diameter in the cup portion and at the face of the valve.

The valve may be assembled from two components. It will include a valve stem, generally 70 and a valve cup, generally 72. The stem may include a valve guide surface 74, a cam or tappet contacting end 76 and a valve head attachment end 80.

The head of the valve, the valve cup 72, is friction welded, or otherwise affixed to the valve stem 70. Of course, an alternative embodiment would be to construct the valve of one piece, however, it is not unusual to have two piece valve assemblies as shown in FIGS. 5–8.

Figure 7:
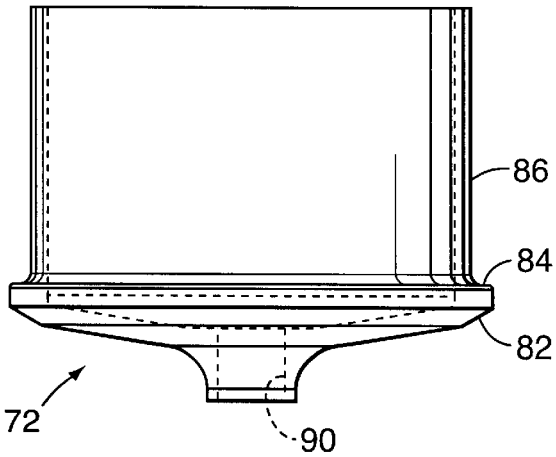
FIG. 7 is a side elevation view of a valve cup.
Figure 6:
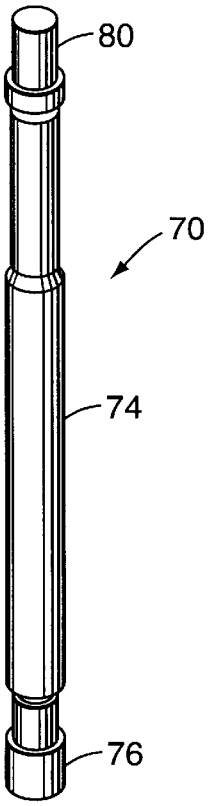
FIG. 6 is an orthographic projection of a valve stem of the cup valve of FIG. 5.
Figure 8:
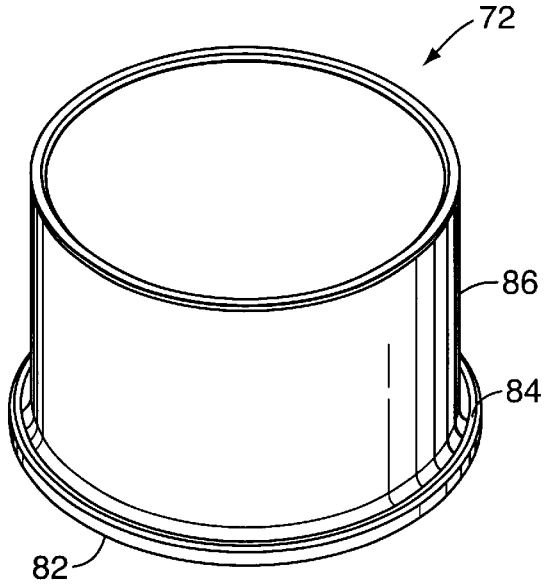
FIG. 8 is an orthographic projection of the cup or head of the valve of FIG. 5.

The valve cup 72 includes a head portion as shown in FIGS. 7 and 8 that has a machined sealing surface 82 on the stem side of the valve cup. The normal face surface 84 supports a circumferential wall 86. This wall, hereinafter sometimes referred to as a "cup," is fixedly attached to the normal face surface 84 of the valve. The attachment can be by friction welding, welding, adhesive, or the like; or alternatively, the wall can be formed integrally with the head of the valve or with a one-piece valve.

As shown in FIG. 7 the underside of the head portion of the valve has a stem receiving bore 90 into which the valve head attachment end 80 will be inserted. These components will be friction welded together or otherwise fixedly attached—stem to valve head.

The wall of the cup 86 is relatively thin, in a preferred embodiment, in order to keep the mass of the valve low. It could, however, include a filled or partially filled interior if desired. As shown in the dotted line representation of FIG. 7 some of the face surface of the valve inside the wall of the cup 86 has been machined away—again for weight reduction and, to some extent, heat dissipation considerations.

Figure 9:
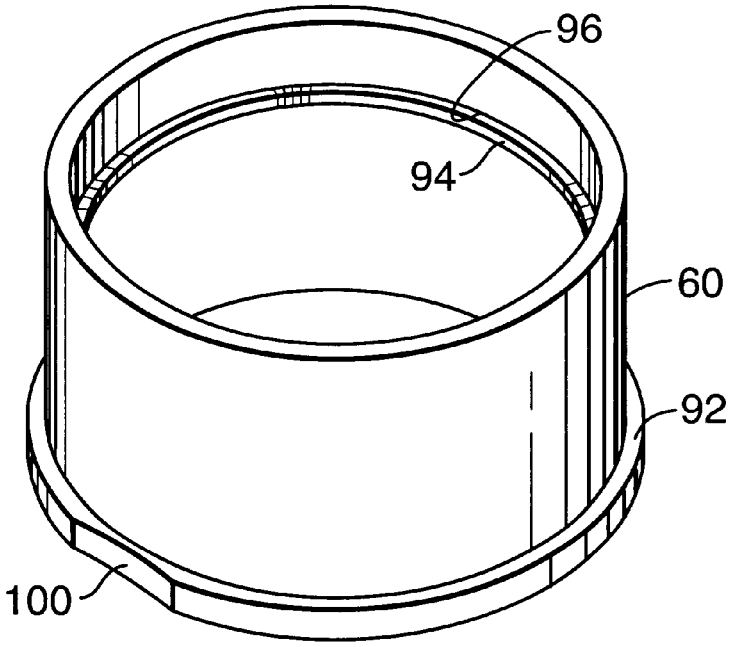
FIG. 9 is an orthographic projection of an intake or exhaust valve bore liner.
Figure 10:
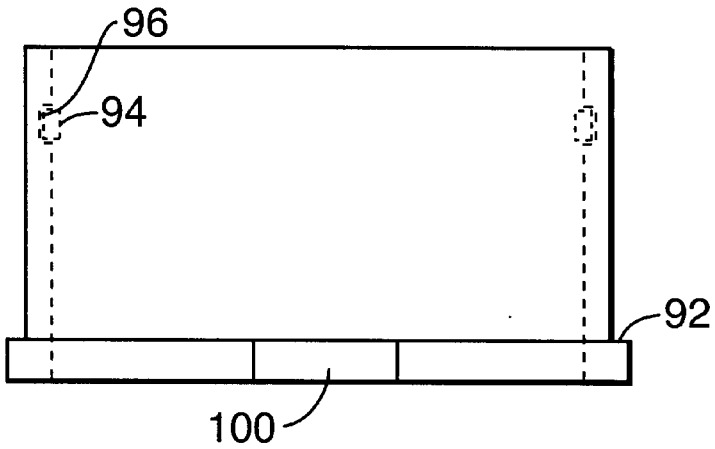
FIG. 10 is a side elevation view of the liner shown in FIG. 9.

FIGS. 9 and 10 illustrate a preferred embodiment of an intake liner 60. The exhaust liner 62 is virtually identical to the intake liner other than in size so only the intake liner 60 will be described. Shown in FIGS. 9 and 10 is an open-ended, cylindrical element having a retainer flange 92 sized to fit into the intake bore recess 26 of FIG. 1. This flange to recess relationship will position the intake liner 60 at the correct depth in the intake bore 22 and prevent the liner from going too deep into the combustion chamber.

The interior dimension of the intake liner 60 is just slightly larger than the outside diameter of the cup of the valve. A very effective seal is insured by the optional or alternative embodiment use of a piston ring 94 carried in a ring groove 96 of the intake liner 60.

As the exhaust liner 62 and the intake liner 60 may be spaced closely together on the head it may be necessary, and is one embodiment presented here, to machine a flat 100, in the retainer flange 92. These two flats, one on the intake liner and one on the exhaust liner, will abut each other and not only allow clearance so that both liners can be properly seated in their respective host bores, but will also tend to reduce liner rotation in the respective intake and exhaust bores.

The liner material may be metal or a composite material having the thermal requirements necessary for performing the liner function.

Figure 4:
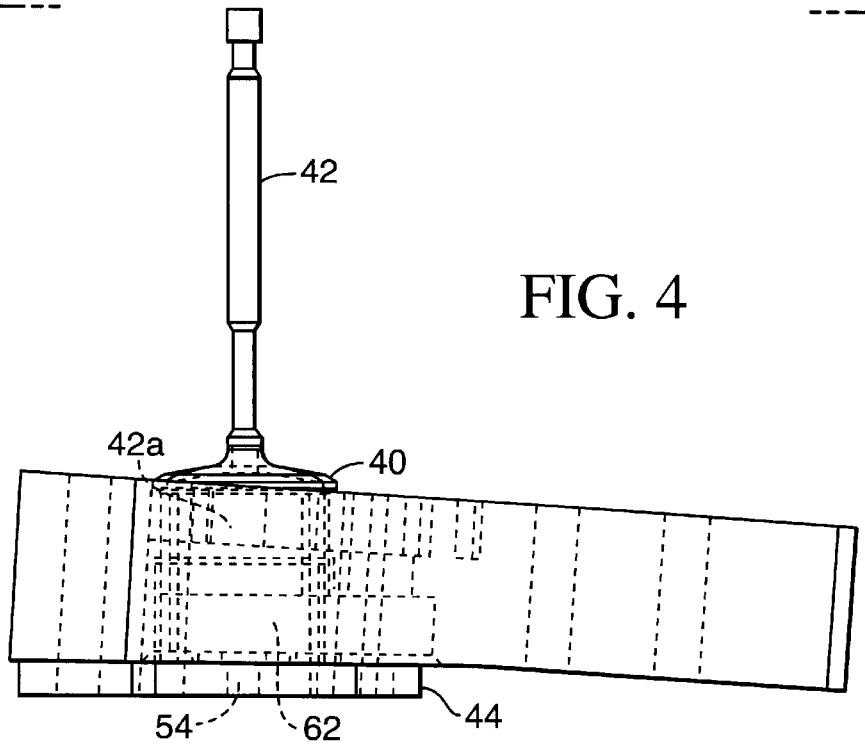
FIG. 4 is a side elevation view of the assembled cylinder head shown in FIG. 3.
Figure 5:
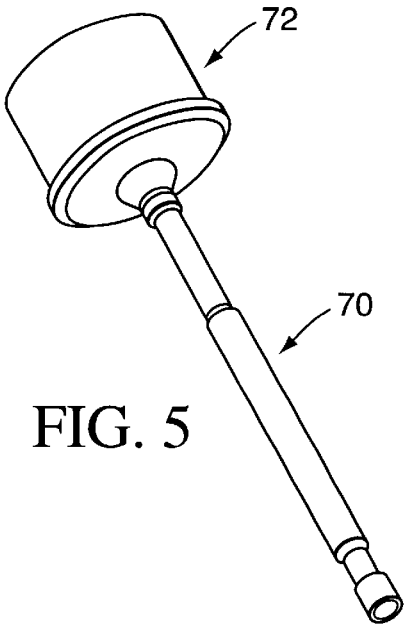
FIG. 5 is a cup valve assembly.

All the salient elements of the head and valves can be seen incorporated into FIGS. 3 and 4. FIG. 3 is a bottom side view of a head and valve assembly showing the head 12, the combustion chamber 32, the intake valve 40, the exhaust valve 42 and the retainer plate 44. No spark plug is inserted in the spark plug hole 20.

Similarly FIG. 4 shows the exhaust valve 42, a portion of the intake valve 40, the head 12, the retainer 44, the exhaust liner 62, a bleed hole 54, and the cup portion 42*a* of the exhaust valve 42.

The reason for the cup portion on the intake and exhaust valves is to increase the efficiency of the combustion process and ultimately reduce hydrocarbon exhaust emissions. This invention increases the compression ratio of the engine without hindering airflow in a four cycle flathead engine. The tall margin on the intake and exhaust valves, the cup circumferential walls such as 86 of the intake valve 40 for instance, when on the valve seats during the compression and power strokes, will occupy space in the combustion chamber 32 thus effectively reducing the overall volume of the combustion chamber of the cylinder head. In a preferred embodiment, the valve cups will extend partially into the cavity of the cylinder head above each valve. In prior art engine configurations there is inefficient combustion due to the volume above the valves making up a significant percentage of the volume of the entire combustion chamber. In the prior engines pockets of unburned hydrocarbons develop. These unburned hydrocarbons are exhausted with the spent gasses during the exhaust cycle. Such unburned hydrocarbons present serious emission problems.

The operation of the valves follows: Starting with both valves closed, the cup portion of each valve will displace a certain volume of space in the combustion chamber. As the intake valve moves off its seat the cup portion will move more deeply into the liner or bore location above the valve. This allows intake gasses to enter the combustion chamber. With the gas/air mixture in the compression chamber, the intake valve head, including the cup portion, will move partially out of the inlet bore or bore liner and the cup portion of the valve will fill a given volume of the combustion chamber. The intake valve cup of the instant invention will occupy the space in the combustion chamber that, in a conventional flathead engine, is part of the combustion chamber—unfortunately directly above a valve in an undesirable zone of the combustion chamber—thereby creating an inefficient condition as the combustion chamber volume includes space above the intake (and exhaust) valves.

This process is repeated on the exhaust stroke as well. On the intake and exhaust strokes, the cups (the tall margins) of the valves, are guided up and out of the path of the incoming and outgoing gasses. The cup portion of each of the valves "hide away" in the intake and exhaust bores formed in the cylinder head when the respective valves are open.

It is the intent of the inventor to harness the pressure/vacuum cycle that generated as the valves move up and down in the bores of the cylinder head. As shown in FIG. 1, et seq., the holes 52 and 52 are ports that lead to the cavities in which the valves move up and down. When a valve moves upward in the bore it will force a certain amount of air out of the chamber. When the valve closes it will create a vacuum in the same chamber. This pulse and vacuum generation is harnessed to drive a pulse drive fuel pump, for instance. A check valve system is implemented as one design of such a pulse generation pump. The check valve will allow airflow, and a pulse, in one direction and this pulsed pressure acts on a diaphragm type pump or the like, to drive the pump. Several combinations of check valves are possible. The idea is to harness the pressure/vacuum cycle to create a pulse drive source to drive a pump or vacuum motor.

In summary, the invention comprises a system for use in an internal combustion engine. The engine includes an access port, having a valve seat, leading into a combustion chamber. A valve having a land portion, a valve face portion and a tubular portion is carried in the engine. The valve has a tubular, or cup shaped extended margin extending outward from the face of the valve. The cylinder head of the engine incorporates a recess formed in the head portion to accommodate the tubular portion of the intake valve. The tubular portion of the valve will project into the combustion chamber when the valve is open or closed. It may also, and will in a preferred embodiment, extend into the recess in the head portion when the valve is open or closed. In a less than optimal configuration, the tubular portion of the valve can be substantially outboard of the recess in the head when the valve land is in contact with the valve seat formed in the engine block.

The valve itself comprises a double ended valve stem that has the valve head portion attached to one end of the valve stem. The valve head portion has a land surface formed on the peripheral edge of the valve head portion, and also has a face surface. A tubular element is affixed to and extends from the face surface of the valve head portion. The tubular portion is open ended to define an internal volume and the open end of the tubular portion is spaced from the face of the valve head. All, or less than all, of the internal volume of the tubular portion may be filled with material. In a preferred embodiment the tubular element is a solid extending from and attached to the face of the valve.

The method of improving engine efficiency, reducing emissions and increasing the compression ratio of an "L-head" internal combustion engine is accomplished by performing the following acts. A cavity is formed in the cylinder head of the engine. The cavity is located in the cylinder head in line with a valve of the engine. The intake and exhaust valves move into the cavity when access to the combustion chamber is desired. The valves will have the tubular portion, as described above, that move into the cavity of the cylinder head and will occupy volume in the combustion chamber when the valve moves out of the cavity to a closed position.

The embodiments disclosed above are the preferred embodiments of the invention however, there are modifications and alternatives that may be desirable in certain circumstances. For instance, it is possible to practice the invention without the use of the intake and exhaust liners. The bores will just be machined in the head above the valves with a good surface finish and possibly a piston ring groove to accept an internal piston ring.

Another alternative is to make the liners out of carbon fiber for good wear and heat dissipation.

In addition, it may be found that very good operating results, or at least improved emissions, can be achieved by using only a single valve with the cup configuration and the other valve with a conventional head or valve margin height. Of course, more than two valves per cylinder are possible and any number of these can have the increased height margin or cup configuration.

Another option is to have the bleed holes in the retainer plate quite large to reduce any air flow impediments. Alternatively a bleed passage from the intake liner bore to the exhaust liner bore (or just the bores where liners are not used) performing the same function as the tube from the bleeds mentioned above, is a possibility.

Various of the features, subcombinations and combinations of this invention can be practiced with or without reference to other features, subcombinations and combinations of the invention, and numerous adaptations and modifications can be effected within the spirit of the invention. While particular embodiments of the invention have been shown and described, it will be obvious to those skilled in the art that changes and modifications may be made without departing from the invention in its broader aspects, and, therefore, the aim in the appended claims is to cover all such changes and modifications as fall within the spirit and scope of the invention and the following claims. For instance, in the liners it may be desirable to have more than a single sealing ring, thus the use of multiple rings is contemplated as is the positioning of the rings in the liner or on, or integral with, the cup of the valve. In addition, for instance, the cup of the valve can be made of different materials or filled with different materials, such as various metals, plastics, fiberglass or other similar materials. Such design nuances are contemplated as being within the scope of the invention and intend to be covered by these claims.

What is claimed is:

1. A system for use in an internal combustion engine, the engine having a block portion, a head component, and a combustion chamber formed between the block portion and the head portion, the system including:

an access port leading into the combustion chamber, the access port having a valve seat formed on the port proximate the combustion chamber;

a valve having a land portion, a valve face portion and a tubular portion, the tubular portion extending outward from the face of the valve;

a recess formed in the head portion of the engine to accommodate the tubular portion of the intake valve, the tubular portion of the valve outboard of the recess in the head when the valve land is in contact with the valve seat.

2. A valve for use in an internal combustion engine comprising:

a double ended valve stem;

a valve head portion attached to one end of the valve stem, the valve head portion extending outwardly from the stem;

the valve head portion having a land surface formed on the peripheral edge of the valve head portion, the valve head portion also having a face surface;

a tubular element affixed to and extending from the face surface of the valve head portion wherein the tubular portion is open ended and the open end of the tubular portion is spaced from the face of the valve head wherein less than all of the internal volume of the tubular portion is filled with material.

3. The invention in accordance with claim 2 wherein the entire internal volume of the tubular portion is filled with material.

4. The invention in accordance with claim 2 wherein the tubular element is a solid extending from and attached to the face of the valve.

5. A cylinder head for accommodating an intake valve and an exhaust valve, each valve having a circumferential wall, the cylinder head having a head surface bottom side, the cylinder head comprising:

a monolithic block of material having a cavity formed as a depression in the head surface bottom side;

an intake valve accommodating bore formed in the monolithic block of material, the bore capable of accommodating the circumferential wall of the intake valve;

an exhaust valve accommodating bore formed in the monolithic block of material, the bore capable of accommodating the circumferential wall of the exhaust valve;

an intake bore liner for fitting into the intake valve accommodating bore;

an exhaust bore liner for fitting into the exhaust valve accommodating bore;

a retainer plate covering the intake and exhaust valve accommodating bores and retaining the intake bore liner and the exhaust bore liner in the intake valve accommodating bore and exhaust valve accommodating bore respectively.

6. The apparatus in accordance with claim 5 wherein the retainer plate comprises a bleed hole associated with the intake valve accommodating bore and a bleed hole associated with the exhaust valve accommodating bore.

7. The invention in accordance with 6 wherein the bleed holes of the intake and the exhaust bores provide a pulsed source of pressure.

8. The invention in accordance with 6 wherein the bleed holes of the intake and the exhaust bores provide a pulsed source of vacuum.

9. The invention in accordance with 6 wherein the bleed holes of the intake and the exhaust bores provide a pulsed source of pressure and vacuum.

10. The apparatus in accordance with claim 5 wherein the intake bore liner and the exhaust bore liner have an outer diameter similar to the diameter of the respective intake and exhaust valve accommodating bores and the inner diameters of the intake and exhaust bore liners are sized to accommodate the intake and exhaust valve circumferential wall outside diameters as may be selected for use.

11. The invention in accordance with claim 5 wherein the monolithic block of material comprising the cylinder head includes cooling fins integral with the cylinder head.

12. The invention in accordance with claim 5 wherein the cylinder head is provided with a water jacket to promote cooling of the cylinder head.

13. The invention in accordance with claim 5 wherein the cylinder head is provided with a through bore to accommodate a sparkplug and the retainer plate comprises a relief zone allowing access to the through bore in the cylinder head when the retainer plate is mounted to the cylinder head.

14. A method for increasing the compression and reducing harmful emissions from an internal combustion engine, the engine having a removable cylinder head, an intake valve and an exhaust valve, a block portion to which the head is attached, and an intake and an exhaust valve, comprising the acts of:

removing the cylinder head from the engine block;

replacing the intake and exhaust valves with intake and exhaust valves having a circumferential wall extending above the faces of each of the valves;

installing a second cylinder head on the engine block, the second cylinder head comprising;

a monolithic block of material having a cavity formed as a depression in the head surface bottom side;

an intake valve accommodating bore formed in the monolithic block of material;

an exhaust valve accommodating bore formed in the monolithic block of material;

an intake bore liner for fitting into the intake valve accommodating bore;

an exhaust bore liner for fitting into the exhaust valve accommodating bore;

a retainer plate covering the intake and exhaust valve accommodating bores and retaining the intake bore liner and the exhaust bore liner in the intake valve accommodating bore and exhaust valve accommodating bore respectively.

* * * * *